United States Patent [19]

Coloma

[11] 4,038,851

[45] Aug. 2, 1977

[54] TOGGLE BOLT SETTING TOOL

[76] Inventor: Antonio Coloma, 25-69 33rd St., Astoria, N.Y. 11102

[21] Appl. No.: 736,076

[22] Filed: Oct. 27, 1976

[51] Int. Cl.[2] ..... B21J 15/34

[52] U.S. Cl. ..... 72/114

[58] Field of Search ..... 72/114, 391, 409, 450; 29/243.5, 243.54, 244; 85/70, 71

[56] References Cited

U.S. PATENT DOCUMENTS

| | | | |
|---|---|---|---|
| 1,102,937 | 7/1914 | Malaby | 72/391 |
| 2,115,251 | 4/1938 | Buck | 85/71 |
| 2,148,977 | 2/1939 | Buck | 85/71 |
| 2,399,442 | 4/1946 | Luce | 72/391 |
| 2,428,458 | 10/1947 | Hollwarth | 72/391 |

FOREIGN PATENT DOCUMENTS

| | | | |
|---|---|---|---|
| 608,218 | 9/1948 | United Kingdom | 85/71 |

*Primary Examiner*—C.W. Lanham
*Assistant Examiner*—Gene P. Crosby
*Attorney, Agent, or Firm*—Mark T. Basseches; Paula T. Basseches

[57] ABSTRACT

The present invention is directed to a setting tool for toggle bolts of the type which include pressure collapsible shanks, the tool enabling a toggle bolt to be mounted thereon, inserted in an aperture, such as an aperture in a ceiling, wall or the like, and set by activation of the tool into permanent position within the aperture.

9 Claims, 8 Drawing Figures

TOGGLE BOLT SETTING TOOL

BACKGROUND OF THE INVENTION

Field of the Invention

The present invention is in the field of a setting tool for locking a toggle bolt into seated position in an aperture in a wall or the like.

The Prior Art outer said

As conducive to an understanding of the advance of the present invention, a brief discussion of the problems inhering in the application of collapsible shank toggle bolts is considered helpful.

As is well known, toggle bolts are frequently employed to provide an anchor point for loads to be applied to walls, ceilings and like structures which are typically fabricated of materials the structural integrity of which is insufficient to support a screw or nail driven thereinto. By way of example, so-called wallboard or plasterboard or sheet rock is comprised of an inner and an outer layer of cardboard adhesively secured to a core of soft, plaster-like material. A nail or screw driven into such material will have virtually no holding power.

Where it is desired to affix a load to materials of the type described, toggle bolts are now in common use.

In a first type of toggle bolt, an expansible, spring biased pair of fingers is threadedly mounted on the shank of a bolt, the device being mounted to the wall by drilling a relatively large hole sufficient for the passage through the wall of the fingers in collapsed condition. Once beyond the confines of the wall, the fingers spring outwardly, whereupon tightening of the bolt will draw the fingers tightly against the interior surface of the wall, enabling the load to be sandwiched between the head of the bolt and the wall.

Toggles of this spring expansion type have certain known disadvantages, notably the requirement for drilling large holes and the requirement that a substantial space be provided behind the wall so that the spring fingers may pass entirely through the wall with sufficient clearance to snap outwardly to the expanded condition.

The tool of the present invention is not applicable to the above described spring toggle but is intended to be used with a collapsible shank toggle as hereinafter described.

The expansible shank toggle bolt includes a flange and a cylindrical shank, the shank being provided with longitudinally extending slots which enable the shank to be expanded responsive to forces which urge the distal end of the shank toward the flange. Expansion of the shank in this form of toggle is effected by a bolt member, the head of which lies adjacent the flange and the shank of which is threadedly connected to a threaded receiver member secured to the shank of the toggle adjacent the distal end thereof.

Application of the expansion type toggle is effected by inserting the shank of the toggle through a hole in the wall and, while holding the flange still against rotation relative to the hole, tightening the bolt component of the toggle. In the course of tightening, the under surface of the head of the bolt is pressed against the flange and the receiver portion of the toggle shank is progressively advanced toward the flange. The compressive forces exerted against the toggle shank cause the same to expand radially and clamp against the inner surface of the wall, the wall thus being engaged on its opposed faces by the expanded shank and the flange.

The application of toggles of the type described is an exceedingly difficult process due, in large measure, to the lack of structural integrity of the wall materials to which toggles are ordinarily applied. It will readily be recognized that the torque required for initial rotation of the bolt in setting the toggle is extremely high, due to the cylindrical configuration of the toggle shank. The high torque required to be applied, coupled with the fact that the flange does not provide a facile gripping surface, often results in a relative rotation of the flange with respect to the wall rather than a desired relative rotation of the bolt and flange.

In order to prevent the body of the toggle from rotating in the wall under setting torque, certain bolt constructions employ spurs or tangs on the under surface of the flange which may be forced into the wall surface. Often, however, the large amount of torque required to initiate collapsing of the shank causes the spurs to break free and rip through the cardboard covering of the dry wall.

SUMMARY

The present invention may be summarized as directed to a setting tool for the application of collapsible shank toggle bolts (as opposed to spring activated bolts) into a dry wall or like material. The tool includes a frame carrying a base plate and a puller plate. The puller plate and base plate include registering slots enabling a toggle bolt to be mounted with the locking flange adjacent the base plate and the head of the bolt adjacent the puller plate. Mechanical advantage means are provided for urging the puller plate away from the base plate, whereby the head of the bolt is withdrawn, inducing the collapse of the shank without the application of any torque. By this means the tearing of the protective cardboard coating of the so-called dry wall is prevented, increasing the effectiveness of attachment of the toggle.

The invention is further characterized by the fact that the toggle bolt assemblies may be secured to the tool so as to be supported thereon, such that the tool may be grasped and a toggle inserted at a remote position without fear that the toggle will fall free of the tool.

To attain these objects and such further objects as may appear herein or be hereinafter pointed out reference is made to the accompanying drawings, forming a part hereof, in which.

Figure 1:
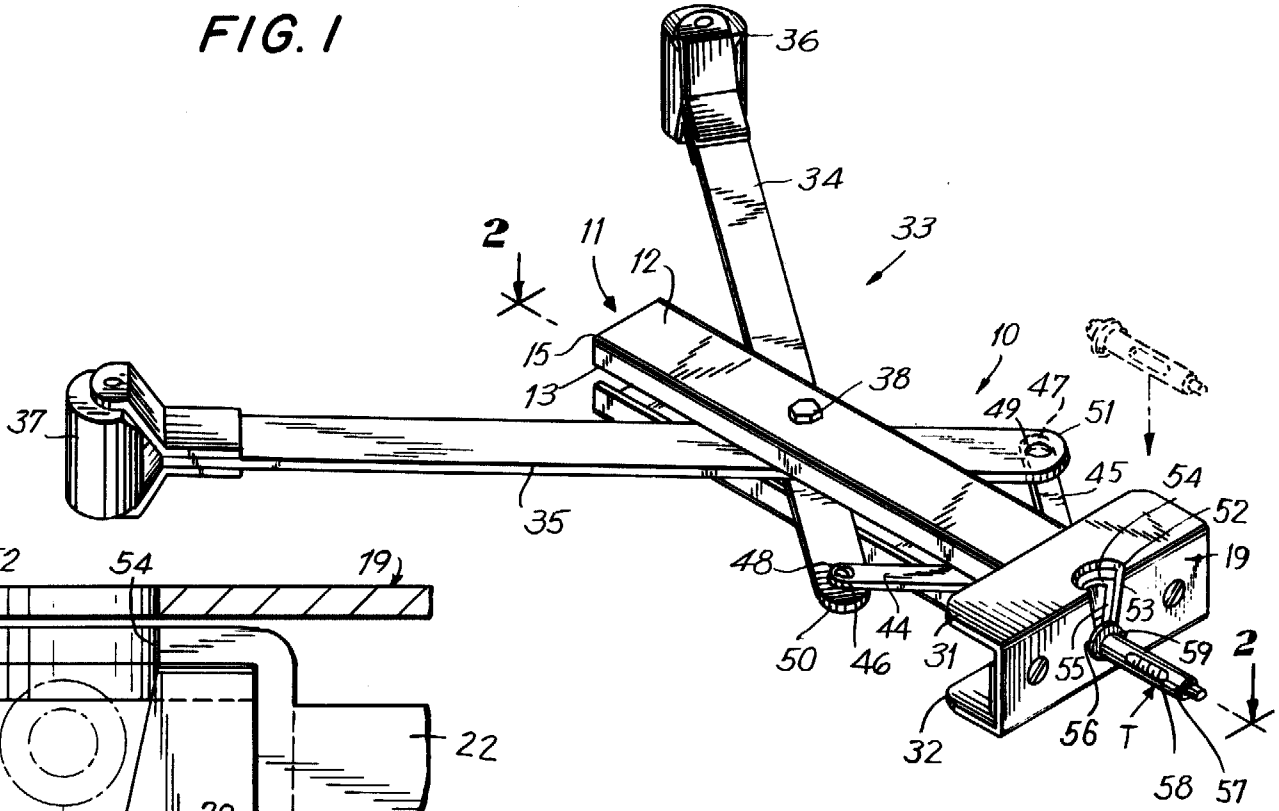
FIG. 1 is a perspective view of a setting tool in accordance with the invention.

Referring now to the drawings, the tool 10 includes a frame member 11 which preferably may be in the form of a tubular body 12 which is square in transverse section. The body 12 is provided with an opposed pair of slots 13, 14 extending longitudinally from the rear end 15 toward the front end 16, the slots 13, 14 terminating short of the front end 16, as at 17 and 18 respectively — see FIGS. 2 and 5.

A base plate member 19 is carried in covering relation of the front end 16 of the body 12. The base plate 19 may be secured to the body 12 by a pair of bolts 20, 21 countersunk into and extending through the base plate and through lateral flanges 22, 23, respectively, which may be formed integrally with the body portion or may be attached thereto as by welding. Nuts 24, 25 bearing against the flange 22, 23, respectively, maintain the parts in the noted position.

A puller plate assembly, identified generally as 26, is movably mounted within the tubular body portion 12. The puller plate assembly 26 is generally U-shaped in vertical section, including an upper leaf or leg 27, a lower leg 28, and a front or puller plate 29. The legs 27, 28 lie adjacent the upper and lower walls of the square tubular body 12 and are guided thereby for linear movement.

The puller plate 29, in its forwardmost position, lies directly adjacent the inner face 30 of the base plate 19, which base plate, as best appreciated from FIG. 1, may itself be U-shaped in section and include upper and lower branches 31, 32, respectively, joined to the front or base plate 19.

Figure 2:
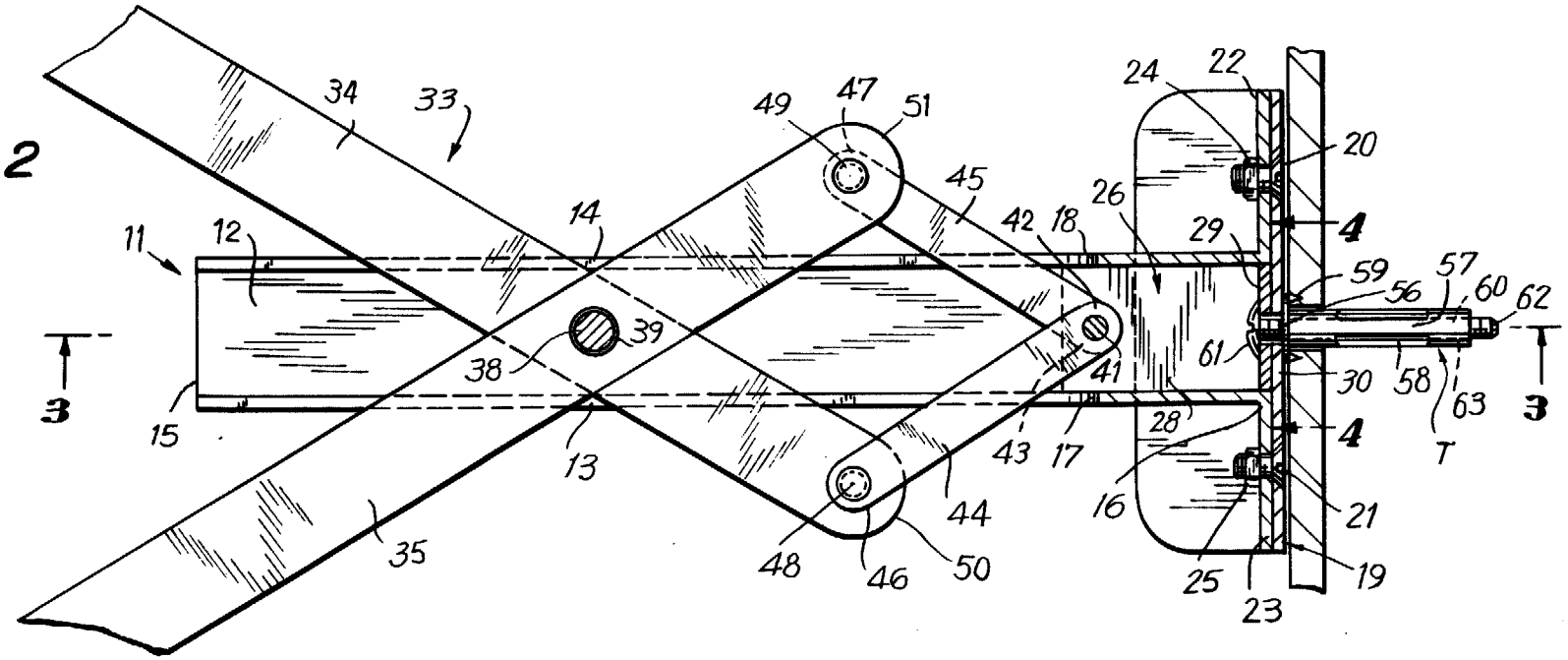
FIG. 2 is a longitudinal section taken on the line 2—2 of FIG. 1.
Figure 3:
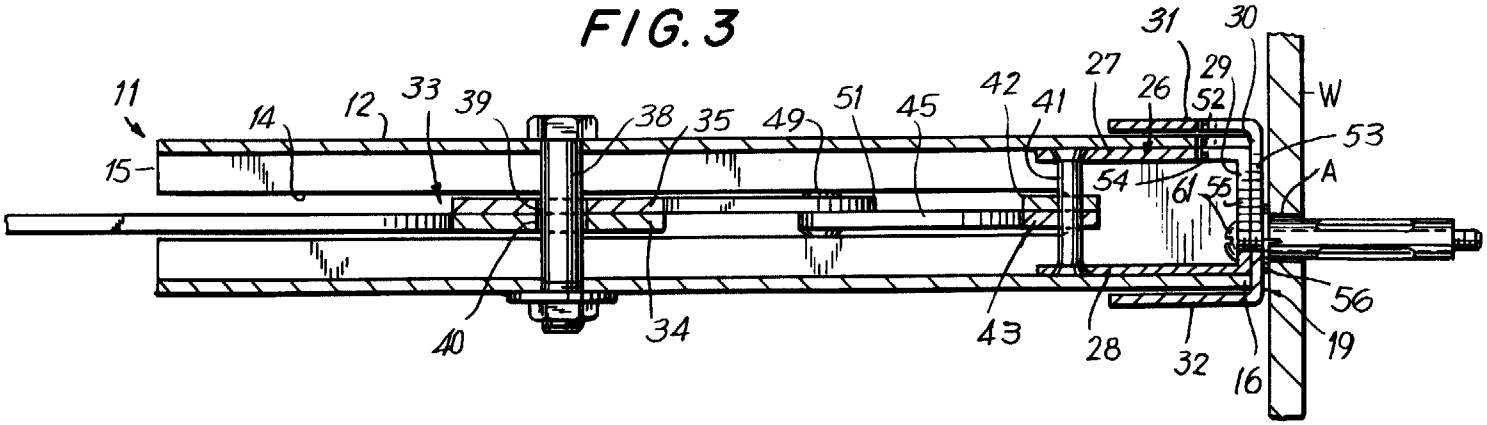
FIG. 3 is a section taken on the line 3—3 of FIG. 2.
Figure 5:
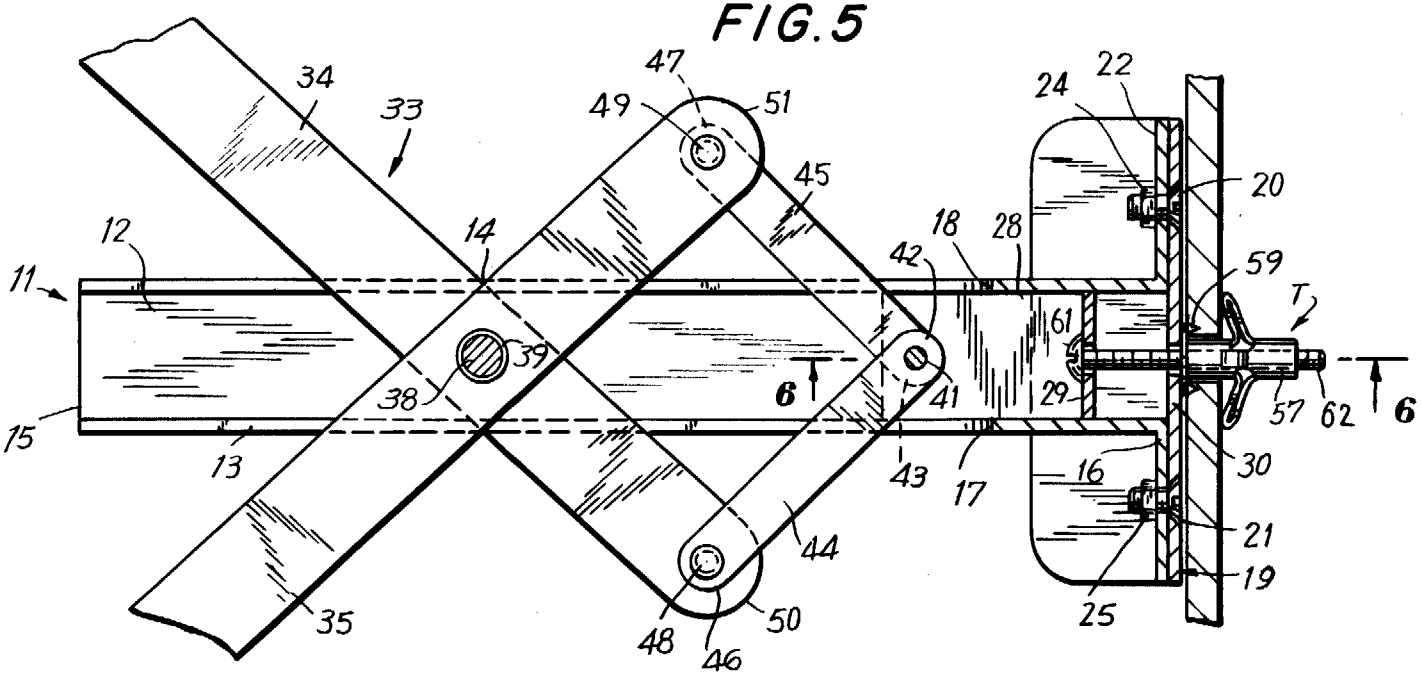
FIG. 5 is a section similar to FIG. 2 showing the position of the parts after setting of the toggle.
Figure 6:
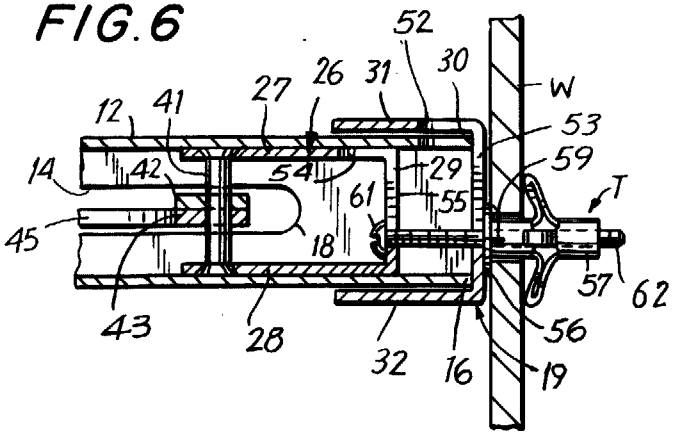
FIG. 6 is a section taken on the line 6—6 of FIG. 5.

Apparatus is provided for urging the puller assembly 26 from its forwardmost position, shown in FIG. 2 and 3, to the rearward position shown in FIGS. 5 and 6. While a number of means developing substantial mechanical advantage may be employed for such purpose, the preferred mechanism comprises a lazy tongs assembly 33.

The lazy tongs assembly includes a pair of activator levers 34, 35 having operator handles 36, 37 supported at their outer ends. The levers 34, 35 extend in overlapping relation through the clearance slots 13, 14 in the body portion 12. The levers are fulcrumed on a cross bolt 38 which extends vertically through the body portion 12.

As best seen in FIG. 3, the upper lever 35 is provided with an aperture 39 and the lower lever 34 with an aperture 40, loosely mounted on the cross bolt 38. The inner cross pin 41 extends between the upper and lower legs 27, 28 of the puller assembly 26, the pin 41 forming a fulcrum for the ends 42, 43 of driver links 44, 45, respectively. The outer ends 46, 47 of the links 44, 45, respectively, are pivotally connected by pins 48, 49, respectively, to the levers 34 and 35, respectively adjacent their distal ends 50, 51, respectively.

Figure 4:
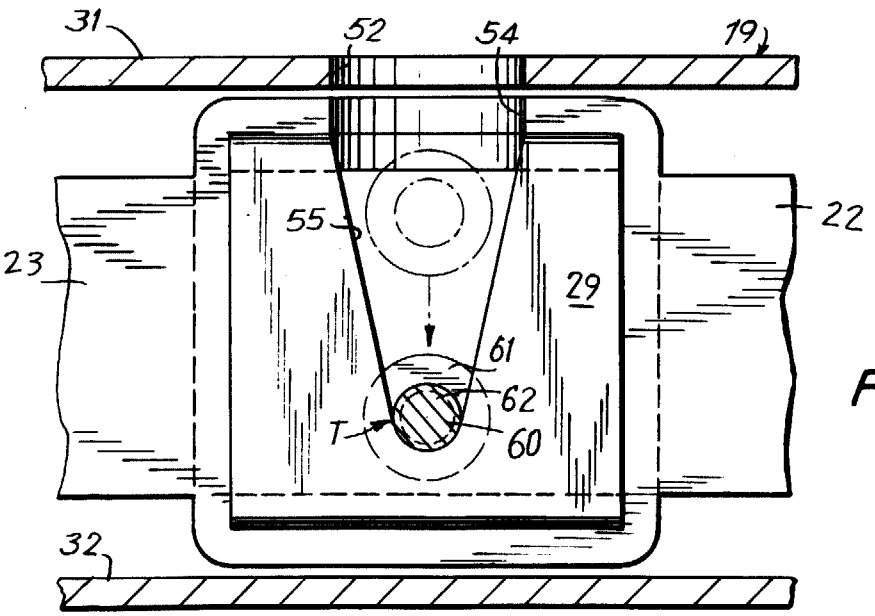
FIG. 4 is a magnified section taken on the line 4—4 of FIG. 2.

The above mechanical arrangement will be readily appreciated to be known as a lazy tongs connection and will operate, upon spreading of the handles 36, 37, to induce a readward movement of the puller assembly 26 from the position shown in FIGS. 3 and 4 to that of FIGS. 5 and 6.

It will be further understood that since the distance between the handles 36, 37 and pivot 38 is greater than the distance between the pins 48, 49 and the pivot 38, a substantial mechanical advantage and force multiplication is achieved in the rearward movement of the puller assembly 26.

In order to permit the attachment of the toggle members T, the base plate assembly including the plate 19 and the puller assembly 26 are provided with registering slots. Specifically, slot 52 is formed in the upper branch or leaf 31 of the base plate assembly, a continuation 53 of such slot being formed in the front or base plate 19. In similar fashion, a slot 54 is formed in the upper leg or leaf 27 of the puller assembly 26, a continuation 55 of such slot being formed in the puller plate 29.

As best seen in FIGS. 1 and 4, the slots 52, 53 in the base plate and 54, 55 in the puller plate taper from a widest portion at the leaves or branches 31 and 27, respectively, to progressively narrower dimensions at positions further from the entry portions 52 and 54 of the solts.

The operation of the apparatus will next be described in connection with a typical expansible shank type toggle bolt. Briefly, the toggle bolt T comprises a flange 56 having a cylindrical expansible shank 57, slotted as at 58 to reduce the forces required for spreading of the shank. The flange may include inturned spurs, such as 59. A bolt member 60 includes a head 61 and a threaded shank 62, the shank being engaged with a complementally threaded receiver portion 63 internally of the toggle bolt.

Figure 7:
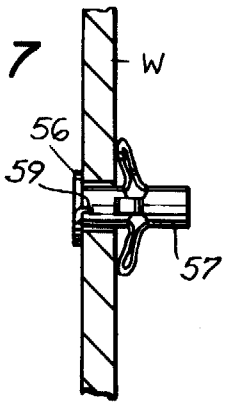

Conventionally, the toggle bolt is shifted to the anchored condition shown in FIG. 7 by rotating the head 61 of the bolt through the use of a screw driver whereby the receiver portion 63 at the distal end of the shank is caused to be moved toward the flange 56, collapsing the shank. It will be appreciated that the torque necessary to rotate the head 61, coupled with the fact that it is difficult or impossible to grip the flange 56, which must be prevented from rotating, may cause a relative rotation between the entire toggle assembly and the wall member W to which it is to be anchored, which rotation would produce concomitant rotation of the spurs 59 and a gouging of the face of the wallboard material. In the operation of the present device, such gouging is impossible.

The first step in applying the toggle with the instant setting tool is to mount the toggle on the setting tool. Such mounting is effected by slightly backing off the head 61 of the bolt 60 to produce a spacing between the head and the flange 56. The bolt may thereupon be introduced onto the setting tool by a downward movement from the dot and dash to the solid line position illustrated in FIG. 1.

It will be appreciated that when the bolt is mounted on the setting assembly, the puller plate 29 should be in its forward position adjacent the rear face of the base plate 19, i.e. in the position of FIGS. 2 and 3. The toggle is moved downwardly within the aligned slots in the base plate and puller assemblies until the shank 62 of the bolt 60 is wedged into a narrow portion of the slots.

With the parts thus positioned, the shank 57 of the toggle may be rotated relative to the wedged shank, clamping the toggle in position with the head 61 engaging the puller plate 29 and the flange 56 engaging the front surface of the base plate 19.

It will be observed that after the noted rotation, the toggle is lightly clamped to the setting device and will not accidentally become dislodged therefrom. In this manner, if the toggle is to be applied in an aperture in the ceiling or other difficult to reach position, for instance, the toggle may be positioned by an operator grasping the handles 36, 37. The toggle is forced inwardly through the aperture A in the wall W until the flange 56 abuts the wall. With the parts thus positioned, setting is effected merely by spreading the handles 36, 37, which spreading movement withdraws the bolt from the position of FIGS. 2 and 3 to the position of FIGS, 5 and 6. The setting movement will upset the shank 57 of the toggle.

The tool may now be removed by returning the puller assembly to its forward position, whereat the slots of the puller and base plate are again in registry, and thereafter laterally shifting the setting device.

Figure 8:
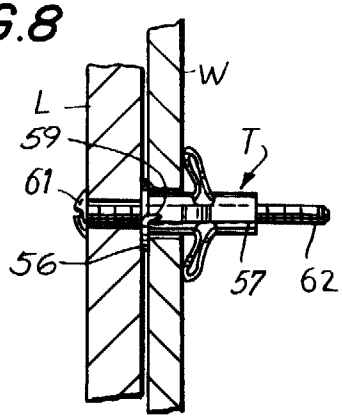
FIGS. 7 and 8 are sectional views through toggles showing the same respectively in their set and load carrying positions.

In order to utilize the now set toggle, the bolt is removed as shown in FIG. 7, a Load L is disposed in the desired position, and the bolt 60 reapplied —see FIG. 8.

By virtue of the tapered nature of the slots in the puller and base plate assemblies, it will be appreciated that a wide range of sizes of toggle bolts may be set in position without adjustment or modification of the device.

It will be further observed that the setting of the bolt does not involve the application of torque to the toggle component, whereby the possibility of damage to the wallboard is minimized.

As numerous modifications and variations may be made in specific details of the device in the light of the above disclosure without departing from the spirit of the invention, the invention is to be broadly construed within the scope of the appended claims. It will, for instance, be readily recognized that alternative mechanical advantage developing means may be substituted for the lazy tongs device of the preferred embodiment.

Having thus described the invention and illustrated its use, what is claimed as new and is desired to be secured by Letters Patent is:

1. A setting tool for collapsible shank toggle bolts of the type which include a stop flange, a collapsible shank extending from said flange, a threaded receiver portion at the distal end of said shank and a bolt member having a head disposed adjacent said flange and a shank axially movable within said shank of said toggle and threadedly engaging said receiver portion, comprising a frame member including a base plate having an inner and an outer face and a slot formed between said faces, said slot including first portions sized to permit the passage therethrough of said head and shank of said bolt, and other portions sized to prevent the passage of said flange, a puller plate abutting said inner face of said base plate, said puller plate including a slot in registry with said slot of said base plate, said slot of said puller plate including first portions sized to permit the passage therethrough of said head and shank of said bolt and other portions sized to prevent the passage of said head and permit the passage of said shank, said first and other portions of said slot of said base plate being in registry with said first and other portions, respectively, of said slot of said pulley plate, whereby a said toggle may be mounted in clamping relation of said plates with said flange engaging said outer face of said base plate and the under surface of said head engaging the face of said puller plate remote from said base plate, and mechanical advantage means on said frame engaging said puller plate for shifting said puller plate inwardly away from said base plate, thereby to shift said receiver portion toward said flange and collapse said shank.

2. Apparatus in accordance with claim 1 and including guide means interposed between said base plate and puller plate for guiding said puller plate in a linear path relative to said base plate responsive to activation of said mechanical advantage means.

3. Apparatus in accordance with claim 1 wherein said mechanical advantage means comprises a lazy tongs linkage having a fixed fulcrum mounted to said frame and a movable fulcrum mounted to said puller plate.

4. Apparatus in accordance with claim 1 wherein said slots of said base plate and said puller plate open to lateral edge portions of said plates, whereby a said toggle bolt may be inserted into said clamping position responsive to a movement of said bolt in a direction parallel to the plane of said base plate.

5. Apparatus in accordance with claim 1 wherein said slots taper progressively from a wide dimension at said first portion to a narrowest dimension adjacent said other portion.

6. A setting tool for collapsible shank toggle bolts of the type which include a stop flange, a collapsible shank extending from said flange, a threaded receiver portion at the distal end of said shank and a bolt member having a head disposed adjacent said flange and a shank axially movable within said shank of said toggle and threadedly engaging said receiver portion, comprising a frame member including a base plate having an inner and an outer face and a slot formed between said face, said slot having an open end portion extending to a lateral edge of said base plate and including gripper portions sized to permit the passage therethrough of said shank of said bolt but not said flange, a puller plate abutting said inner face of said base plate, said puller plate including a slot having an open end extending to a lateral edge of said plate, said slot including gripper portions sized to permit the passage therethrough of said shank of said bolt but not said head of said bolt, said slots of said plates being disposed in registry and having said open ends faced in the same direction whereby a said toggle bolt may be mounted in clamping relation of said plates responsive to a movement of said toggle in the direction of said slots, with said flange engaging said outer face of said base plate and the under surface of said head engaging the face of said puller plate remote from said base plate, and mechanical advantage means on said frame engaging said puller plate for shifting said puller plate inwardly away from said base plate, thereby to shift said receiver portion toward said flange and collapse said shank.

7. Apparatus in accordance with claim 6 and including guide means interposed between said base plate and puller plate for guiding said puller plate in a linear path relative to said base plate responsive to activation of said mechanical advantage means.

8. Apparatus in accordance with claim 6 wherein said mechanical advantage means comprises a lazy tongs linkage having a fixed fulcrum mounted to said frame and a removable fulcrum mounted to said puller plate.

9. Apparatus in accordance with claim 6 wherein said slots taper progressively from a wide dimension adjacent said open ends to a narrow dimension adjacent said gripper portions.

* * * * *